US007000591B1

(12) United States Patent
Raetzman et al.

(10) Patent No.: US 7,000,591 B1
(45) Date of Patent: Feb. 21, 2006

(54) THROTTLE ASSEMBLY HAVING DEADBAND LINKAGE

(75) Inventors: Roger Raetzman, Kenosha, WI (US); Patrick C. Tetzlaff, Greenfield, WI (US); Peter E. Lucier, Chicago, IL (US); Todd P. Craft, Pleasant Prairie, WI (US)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 10/708,077

(22) Filed: Feb. 6, 2004

(51) Int. Cl.
*F02D 31/00* (2006.01)

(52) U.S. Cl. ..... 123/376; 123/400

(58) Field of Classification Search ..... 123/342, 123/363, 376, 377, 400, 327
See application file for complete search history.

(56) References Cited

U.S. PATENT DOCUMENTS 4,090,065 A 5/1978 Braytenbah et al.
4,362,138 A * 12/1982 Krueger et al. ..... 123/342
4,543,932 A * 10/1985 Sturdy ..... 123/342
4,566,415 A * 1/1986 Iwai et al. ..... 123/361
4,570,592 A * 2/1986 Otobe ..... 123/339.23
4,846,283 A 7/1989 Batcheller
4,903,660 A * 2/1990 Sogawa ..... 123/339.14
5,517,964 A 5/1996 Chen et al.
5,665,025 A * 9/1997 Katoh ..... 477/107
6,196,188 B1 3/2001 Janic et al.

* cited by examiner

*Primary Examiner*—Henry C. Yuen
*Assistant Examiner*—Arnold Castro
(74) *Attorney, Agent, or Firm*—Osler, Hoskin & Harcourt LLP

(57) ABSTRACT

An apparatus and method for adjusting a throttle plate of a throttle assembly of an internal combustion engine is disclosed. A throttle linkage mechanically connects a throttle actuator to the throttle assembly with a deadband therebetween. The deadband allows the throttle plate to remain in a closed position during initial movement of the throttle actuator and initial acceleration, thereby reducing overall engine noise.

30 Claims, 7 Drawing Sheets

THROTTLE ASSEMBLY HAVING DEADBAND LINKAGE

BACKGROUND OF INVENTION

The present invention relates generally to outboard motors, and more particularly, to a throttle assembly having a deadband engagement.

In general, internal combustion engines include at least one cylinder constructed to receive combustion gases that pass through an air intake opening formed in a throttle body attached to the engine. Typically, the amount of combustion gas provided to the cylinder is partly controlled by the position of a throttle plate. As an operator desires increased output from the engine, the operator advances a throttle actuator which in turn opens the throttle plate thereby providing increased amounts of combustion gas to the cylinders. In addition to mechanically actuating the throttle plate, the throttle actuator also initiates increased fuel supplied to the cylinders. In fuel injected engines, the throttle actuator signals an ECU to increase an amount of fuel supplied to the cylinders by a fuel system and, in carbureted engines, the throttle actuator mechanically provides more fuel to the cylinders. As an operator increases the engine speed from idle, the throttle plate gradually opens an amount that is generally proportional to the operator initiated change in throttle actuator position thereby providing more combustion gas to the cylinders of the engine.

As the throttle plate opens in response to the throttle command, in addition to allowing more combustion gas, or air, to pass into the engine, increased amounts of engine noise are allowed to exit the engine through the throttle body and past the throttle plate. Additionally, some known throttle plates have holes formed therethrough. These holes provide an appropriate amount of combustion gas necessary for idle operation of the engine. Those throttle plates which have holes formed therethrough, may cause a whistling, or chirping sound. Alternatively, the throttle plate is held open to allow sufficient air to pass by to maintain idle speed. Those that are held open generally allow engine noise to pass unobstructed. Combustion noise allowed to exit the engine via the air intake, in addition to any whistling or chirping caused by the throttle plate idle holes, can be a distraction to an otherwise well-performing engine. Additionally, a quieter operating engine that eliminates any noise is generally advantageous.

Modern engines often include an integration of a plurality of electrically controlled components. These components can include fuel injection systems, oil injection systems, combustion timing systems, and cooling systems to name a few. These systems are often controlled, in part, by an electronic control unit (ECU). One sensor connected to the ECU is a throttle position sensor (TPS). Commonly, the TPS communicates the position of the throttle plate relative to the throttle body opening, often referred to generically as the air intake, through a series of linkages. By communicating to the ECU the position of the throttle plate, the ECU can calculate the amount of combustion gas passing through the throttle body. By knowing the amount of combustion gas provided to the engine, the ECU can more effectively control the amount of fuel provided to the cylinders as well as ignition timing in order to optimize the operating efficiency of the engine.

Generally, as an operator increases or decreases the throttle actuator, generically referred to as an accelerator, the ECU, via the TPS, measures the throttle input commands and can regulate engine operation in response thereto.

Excessive tolerance in the linkage between the throttle actuator and the throttle plate can make the precise determination of the throttle plate position difficult to ascertain. As such, although the ECU is receiving a signal from the TPS indicative of a throttle plate position, because of play in the linkage, the throttle plate may not be at the exact position indicated by the TPS. As such, the operation of the engine may not be optimized because of the interdependency of these systems on the actual throttle plate position. Additionally, the engine may not be as responsive to throttle input commands as desired.

It would be therefore be desirable to have an engine with a throttle assembly that reduces the amount of noise emitted from the main air intake. To this end, it would be desirable to operate the engine with the throttle plate in a closed position for a range of throttle actuator inputs. It would also be advantageous to reduce play between the throttle actuator and the throttle plate and obtain more accurate throttle plate position indicators.

BRIEF DESCRIPTION OF INVENTION

The present invention provides a throttle assembly that solves the aforementioned problems. The throttle assembly disclosed includes a throttle plate positioned in a throttle body and has a mechanical actuator that engages the throttle plate, but during low speed operation of an engine so equipped, allows the throttle plate to remain closed despite advancement of a throttle actuator through a range of speeds.

In accordance with one aspect of the present invention, a throttle assembly of an internal combustion engine is disclosed which includes a throttle body. A throttle plate is positioned in an opening of the throttle body and is constructed to control passage of combustion gas thereabout when opened. A mechanical actuator engages the throttle plate and has a deadband engagement therebetween whereby a portion of input motion to the mechanical actuator is not translated to the throttle plate.

According to another aspect of a present invention, an outboard motor is disclosed which includes an engine mounted on a midsection attachable to a transom of a boat. A throttle body is attached to the engine and has a passage therethrough with a throttle plate rotatably positioned therein. A throttle linkage is in operable association with the throttle plate to rotate the throttle plate in the passage of the throttle body. An actuator is positioned between the throttle linkage and the throttle plate such that the throttle plate is disengaged from operable association with the throttle linkage during a range of engine operation.

In accordance with a further aspect of the present invention, an engine control system is disclosed which has a mechanical actuator connected to a throttle linkage. A throttle plate is positioned in a first opening of a throttle body and is rotatable between a closed position and an open position. The throttle plate is rotatably connected to the mechanical actuator such that the mechanical actuator is allowed to partially rotate relative to the throttle plate in response to an input from the throttle linkage. The engine control system includes an air intake bypass constructed to maintain flow of combustion air when the throttle plate is closed. Such an engine control system reduces an amount of noise allowed to exit the air intake of the engine while providing an appropriate amount of combustion gas.

According to yet another aspect of the present invention, a throttle assembly is disclosed which includes a throttle linkage connected to a user input, a throttle body having a first air intake opening, and a throttle plate rotatably positioned in the first air intake opening of the throttle body. A throttle translation assembly operably connects the throttle linkage to the throttle plate to provide translation of the throttle plate within one range of operation of the throttle linkage and prevent translation of the throttle plate in another range of operation of the throttle linkage.

According to a further aspect of the present invention, a method of minimizing noise emitted from an intake of an internal combustion engine is disclosed. The method including: providing an air bypass in a location to minimize noise travel toward a user while providing sufficient air for a given range of engine operation, the air bypass having an opening open to atmosphere and directed in a direction different than that of a throttle plate, and allowing acceleration within the given range of operation without a corresponding change in throttle plate position.

In accordance with an even further aspect of the present invention, a method of operating an internal combustion engine is disclosed which includes the step of increasing an amount of fuel provided to a combustion chamber while maintaining a closed throttle plate position.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
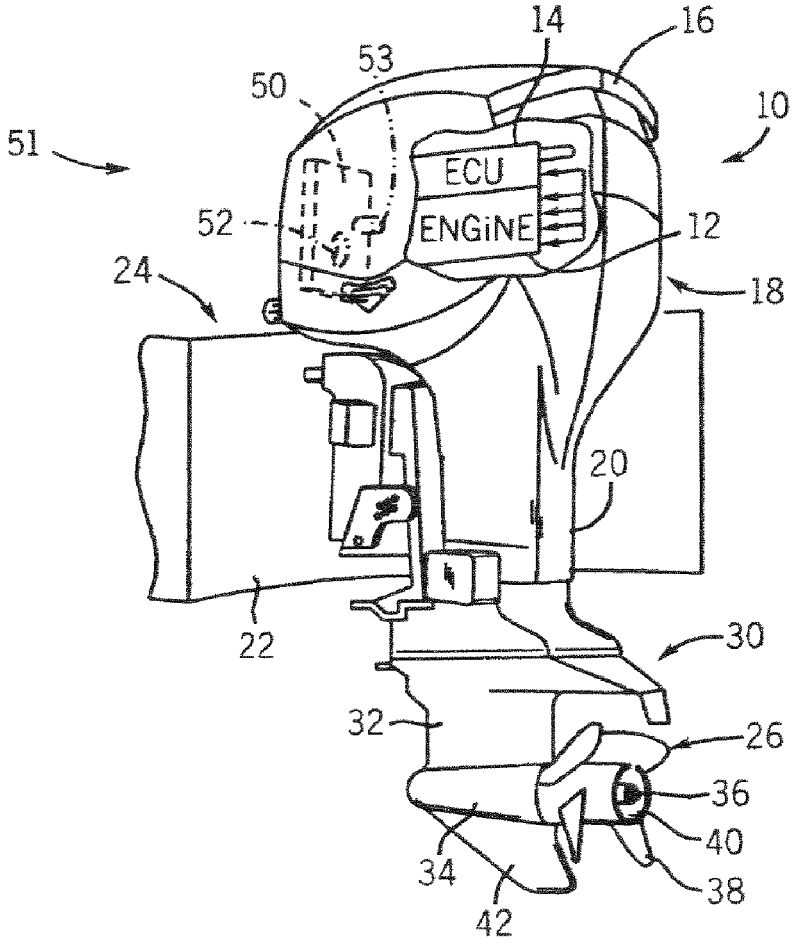
FIG. 1 is a perspective view of an exemplary outboard motor incorporating the present invention.

The present invention relates generally to internal combustion engines. In the present embodiment, the engine is a direct fuel injected, spark-ignited two-cycle gasoline-type engine. FIG. 1 shows an outboard motor 10 having one such engine 12 controlled by an electronic control unit (ECU) 14 under engine cover 16. Engine 12 is housed generally in a powerhead 18 and is supported on a midsection 20 configured for mounting on a transom 22 of a boat 24 in a known conventional manner. Engine 12 is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via midsection 20. A skeg 42 depends vertically downwardly from torpedo section 34 to protect propeller fins 38 and encourage the efficient flow of outboard motor 10 through water.

A throttle body 50 (shown in phantom), is connected to engine 12 and has at least one opening 52 passing therethrough. The number of openings generally corresponds to a number of cylinders in engine 12. Only one is shown for a two-cylinder engine for exemplary reasons. Opening 52 is often referred to as an air intake opening and allows combustion gas, generally air, to pass through throttle body 50 and into engine 12. Another opening 53, an idle air bypass, passes through throttle body 50 and provides an alternate path for combustion gas into and through throttle body 50. As will be described further below, opening 53 is constructed to provide combustion gas to engine 12 during idle and low speed operations.

Figure 2:
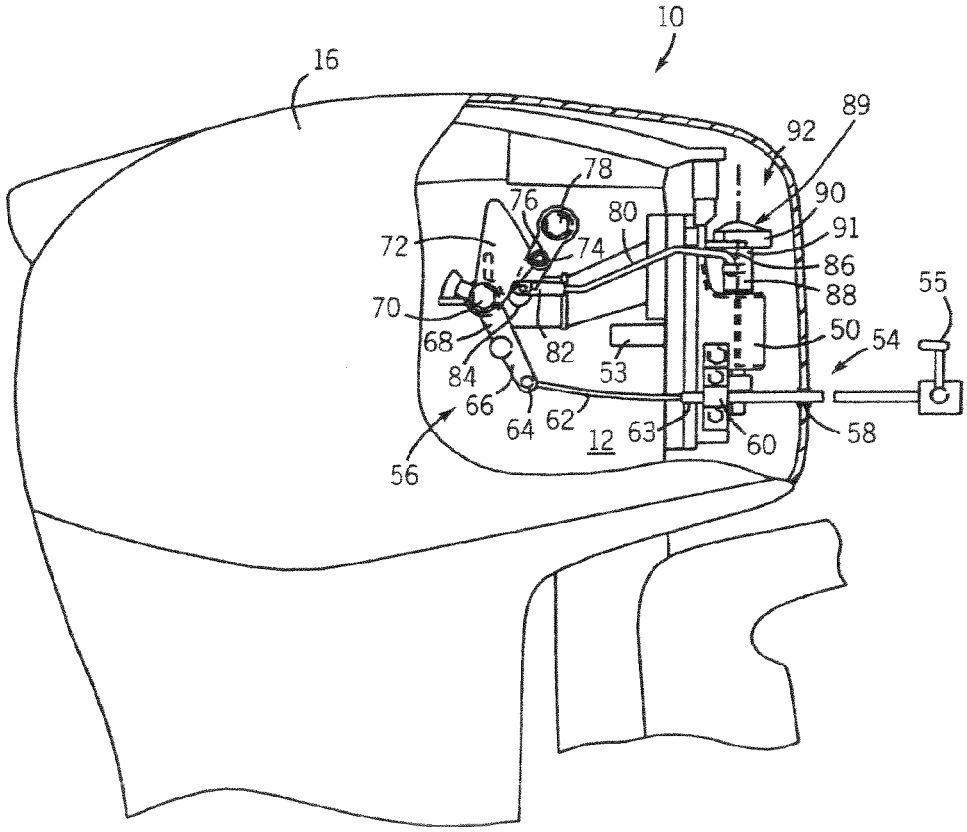
FIG. 2 is an elevational view of a portion of the outboard motor of FIG. 1 showing the throttle linkage and throttle assembly of the present invention.

FIG. 2 shows outboard motor 10 with a portion of engine cover 16 cut away. A throttle cable 54 connects a throttle actuator 55 to a throttle linkage assembly 56 so that throttle linkage assembly 56 is movable in response to operator manipulation of throttle actuator 55. Throttle cable 54 passes through an opening 58 formed in engine cover 16. A mounting bracket 60 secures throttle cable 54 to throttle body 50 and prevents movement therebetween. Throttle cable 54 has a cable 62 which extends from an end 63 thereof. Cable 62 extends and retracts from throttle cable 54 relative to mounting bracket 60 in response to operator manipulation of throttle actuator 55. An end 64 of cable 62 engages a first throttle link 66 of throttle linkage assembly 56. Cable end 64 is attached to a first arm 68 of first throttle link 66 so that movement of cable 62 results in rotation of first throttle link 66 about a pin or mounting bolt 70.

A second arm 72 of first throttle link 66 engages a pin 74 extending from a second throttle link 76 of throttle linkage assembly 56. Second throttle link 76 rotates about a pin 78 and has a third throttle link 80 attached thereto. A first end 82 of third throttle link 80 is connected to an end 84 of second throttle link 76. A second end 86 of third throttle link 80 is attached to an actuator 88 of a throttle assembly 92. During operation, as an operator advances throttle actuator 55, throttle cable 62 moves and rotates first throttle link 66 of throttle link assembly 56 about pin 70. Rotation of first throttle link 66 causes second arm 72 to engage pin 78 and thereby rotate second throttle link 76. Displacement of second throttle link 76 is translated to throttle assembly 92 via third throttle link 80 so that actuator 88 is coupled to throttle actuator 55. Such a linkage forms a throttle assembly that is highly responsive and sensitive to operator manipulation of a throttle actuator.

Referring to throttle assembly 92, a mount 89, preferably having a throttle position sensor (TPS) 90 inside, is connected proximate a first end 91 of actuator 88. The TPS 90 communicates the position of actuator 88 to the ECU of engine 12. In addition to the responsiveness of the throttle assembly, mounting TPS 90 about the actuator of the throttle assembly ensures that an ECU attached thereto is nearly instantaneously aware of operator manipulation of throttle actuator 55. Such a construction connects a throttle linkage assembly and throttle assembly with reduced play therebetween and allows an engine 12 so equipped to be highly responsive to actual throttle position.

Figure 3:
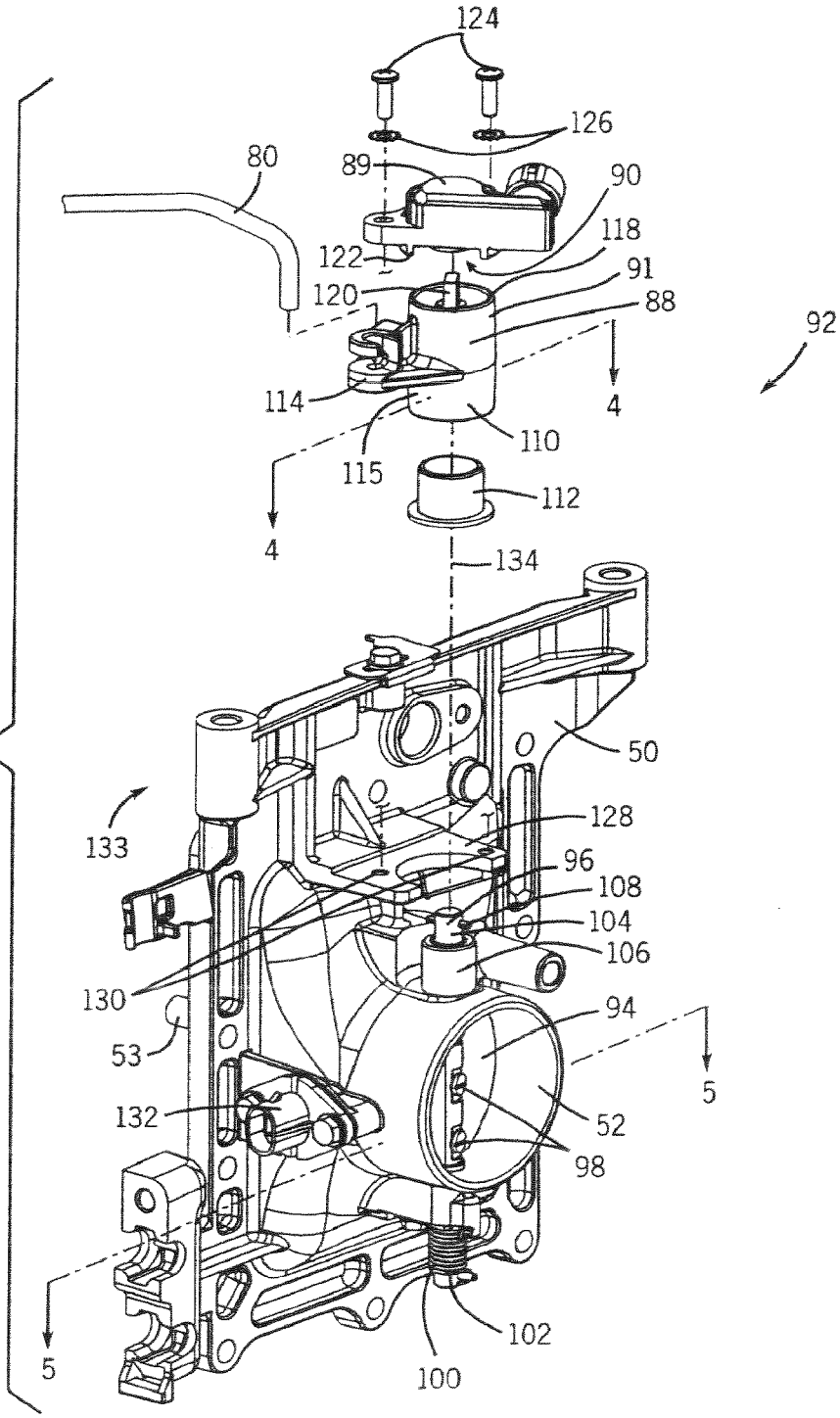
FIG. 3 is an exploded view of the throttle body and throttle assembly of FIG. 2.
Figure 5:
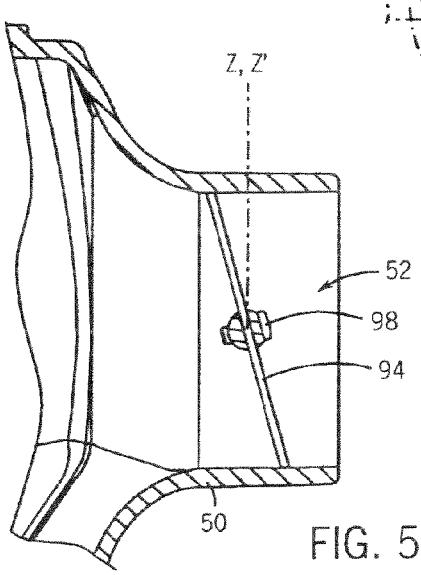
FIG. 5 is a cross-sectional view of a portion of the throttle assembly of FIG. 3 taken along line 5—5 and shows a closed throttle plate position.

FIG. 3 shows an exploded view of throttle assembly 92. Throttle body 50 is mounted to engine 12 with opening 52 in fluid communication with the combustion chambers of engine 12 and in general alignment with a front 51 of engine 12, as best viewed in FIG. 1. The front 55 of engine 12 is in linear alignment with an operator and passengers of watercraft 24. Referring back to FIG. 3, throttle plate 94 is rotatably positioned within opening 52 to regulate air flow through throttle body 50. During idle operation of engine 12, throttle plate 94 remains closed, as shown in FIGS. 3 and 5, and combustion gas is provided to engine 12 via an opening or idle air bypass 53. Opening 53 provides a path for combustion gas into engine 12 when throttle plate 94 prevents the passage of combustion gas through opening 52. Opening 53 is formed in throttle body 50 generally opposite air intake opening 52 and faces generally towards engine 12 and away from the operator and passengers of the watercraft or other recreational product.

Throttle plate 94 is secured to a throttle shaft 96 by a plurality of fasters 98 such that rotation of throttle shaft 96 results in rotation of throttle plate 94. A spring 100 is positioned about a first end 102 of throttle shaft 96 and biases throttle plate 94 to a closed position in opening 52, as shown in FIG. 3. A second end 104 of throttle shaft 96 extends through a mount structure 106 of throttle body 50. A pin 108, preferably a roll pin, extends through throttle shaft 96 and engages a second end 110 of actuator 88. A bushing 112 is constructed to fit about mount 106 and facilitates rotation of actuator 88 relative thereto.

Third throttle link 80 engages an arm 114 of actuator 88. Arm 114 is integrally formed with actuator 88 and extends from a body 115 thereof. By extending from body 115 of actuator 88, arm 114 allows for a generally linear translation of third throttle link 80 to rotate actuator 88. Body 115 has a generally cylindrical shape and extends from first end 91 of actuator 88 to second end 110. First end 91 of actuator 88 has a bearing surface 118 thereabout and an extension, or tab 120, extending therefrom. Tab 120 is constructed to engage throttle position sensor 90 located within mount 89 such that movement of actuator 88 results in a change of signal from throttle position sensor 90. Throttle position sensor 90 is within a mount 89 positioned about first end 91 of actuator 88. It is understood that in those applications where a throttle position sensor is mounted remotely relative to a throttle shaft that throttle position sensor 90 can be merely a molded mount attachable to the throttle body and constructed to support an end of the actuator therebetween.

A flange 122 of TPS mount 89 engages bearing surface 118 of actuator 88 and maximizes a frictionless rotational engagement therebetween. A plurality of fasteners 124 and corresponding washers 126 secure TPS mount 89 to throttle body 50 at a boss, or mounting flange 128, extending from throttle body 50. Mounting flange 128 includes a pair of holes 130 constructed to receive fasteners 124 therein to secure TPS mount 89 to throttle body 50 with actuator 88 disposed therebetween. It is contemplated that a rubber isolator (not shown) between TPS mount 89 and flange 128 would be advantageous to provide isolation and vibration dampening to the TPS. Actuator 88 is free to rotate relative to throttle body 50 and TPS mount 89. As such, operator manipulation of throttle actuator 55, show in FIG. 2, moves third throttle link 80 which in turn rotates actuator 88 relative to throttle body 50 and TPS mount 89.

A temperature probe 132 extends through throttle body 50 into air intake opening 52 on an engine side 133 of throttle plate 94 and is in electrical communication with ECU 14 shown in FIG. 2. Referring back to FIG. 3, temperature probe 132 is positioned in air intake opening 52 such that it does not interfere with rotation of throttle plate 94. Temperature probe 132 communicates to the ECU a temperature of combustion air provided to the engine to allow the ECU to more effectively control overall engine efficiency and, particularly, fuel combustion efficiency. Temperature sensor 132 may be alternately placed in an air box or other air flow path.

Actuator 88, TPS mount 89, bushing 112, and throttle shaft 96 all share a common axis 134. Common axis 134 is the axis of rotation of throttle shaft 96 to which throttle plate 94 is mounted. Although mounted about throttle shaft 96 and directly responsive to operator movement of throttle actuator 55, actuator 88 is partially rotatable about common axis 134 without affecting the position of throttle plate 94. That is, throttle plate 94 remains closed, as shown in FIG. 3, through a predetermined range of operator movement of throttle actuator 55, yet the RPM of the engine increases, as will be described in further detail below with respect to FIGS. 4–9.

Figure 4:
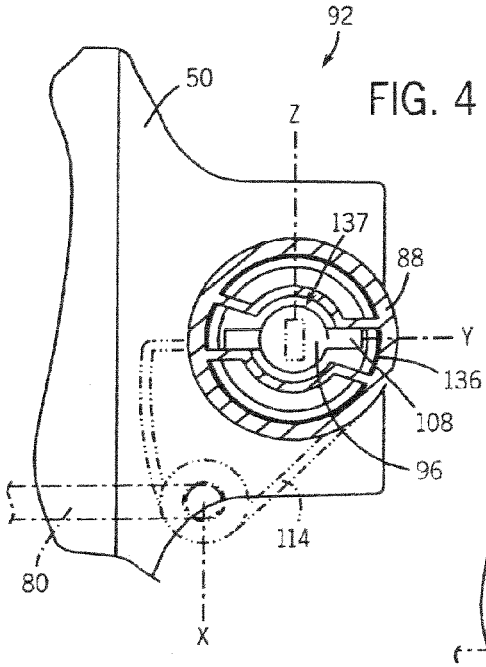
FIG. 4 is a cross-sectional view of a portion of the throttle assembly of FIG. 3 taken along line 4—4 and shows a throttle assembly idle position.

As shown in FIG. 4, when assembled, throttle shaft 96 and pin 108 of throttle assembly 92 are positioned in a recess 136 of actuator 88. Recess 136 has a bowtie shaped cross-section 137 that allows partial rotation of pin 108 and shaft 96 relative thereto. Although shown having a bowtie shaped cross-section it is understood that such a cross-section is merely by way of example and that other arrangements could be used to achieve the result of allowing actuator 88 to determinably engage and disengage from a driving relationship with throttle shaft 96, thereby providing a "deadband" in the throttle linkage. An example of such an arrangement would be a portion of the recess constructed to receive the throttle shaft and another portion of the recess constructed to receive a keying element such as one end of a pin extending from the shaft.

Figure 6:
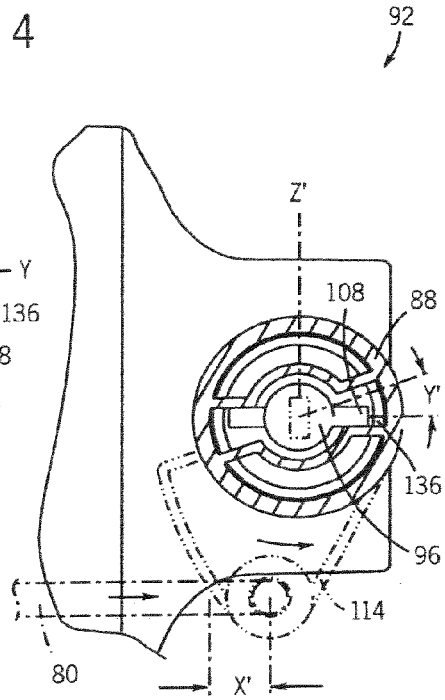
FIG. 6 is a view similar to FIG. 4 and shows the throttle assembly in a throttle assembly transition position.

The relation of actuator 88 to pin 108, as shown in FIG. 4, indicates an idle throttle position. Comparing FIG. 4 to FIG. 6, as an operator advances throttle actuator 55, third throttle link 80 is advanced a distance of X', as shown in FIG. 6. The relation of actuator 88 to pin 108, as shown in FIG. 6 indicates a transition throttle position. The transition throttle position is generally defined as the point during engine operation where the combustion process preferably transitions from a stratified combustion operation to a homogeneous combustion operation wherein stratified and homogenous define the type of combustion charge supplied to the engine, as is known in the art.

The displacement of third throttle link 80 distance X' results in rotation of actuator 88 but does not move pin 108 or throttle shaft 96. When third throttle link 80 is displaced distance X', actuator 88 rotates a distance Y'. In one embodiment, distance Y' is not more than 35 degrees and is preferably approximately 19 degrees. During operation, although an operator has advanced throttle actuator 55 and displaced third throttle link 80 a distance of X', as shown in comparing FIGS. 4 and 6, recess 136 prevents actuator 88 from displacing throttle shaft 98. As such, throttle plate 94 remains closed, as shown in FIG. 5, as actuator 88 is rotated relative thereto. Such a construction forms the deadband in the throttle assembly. One exemplary explanation of the deadband is where the throttle assembly receives an input command having a value of X' and throttle plate 94 does not experience a corresponding output. Such a construction allows throttle plate 94 to remain closed for a predetermined range of engine operation, not merely an engine idle condition.

Throttle plate 94 remains closed, as shown in FIG. 5, up to the transition of throttle position shown in FIG. 6. By maintaining throttle plate 94 closed until approximately the point the engine requires a homogenous combustion charge, a minimum amount of engine noise is allowed to exit the engine through air intake opening 52, while air bypass 53 is sized large enough to provide an adequate charge. By the time that the engine requires a generally homogenous combustion charge, and the throttle plate begins to open with further advancement of the throttle actuator, the overall operating noise of the engine reaches a level that overcomes any noise that may exit the engine through the air intake opening 50. Maintaining throttle plate 94 closed beyond engine idle speed reduces the overall amount of engine noise allowed to exit the engine through air intake opening 52.

Figure 7:
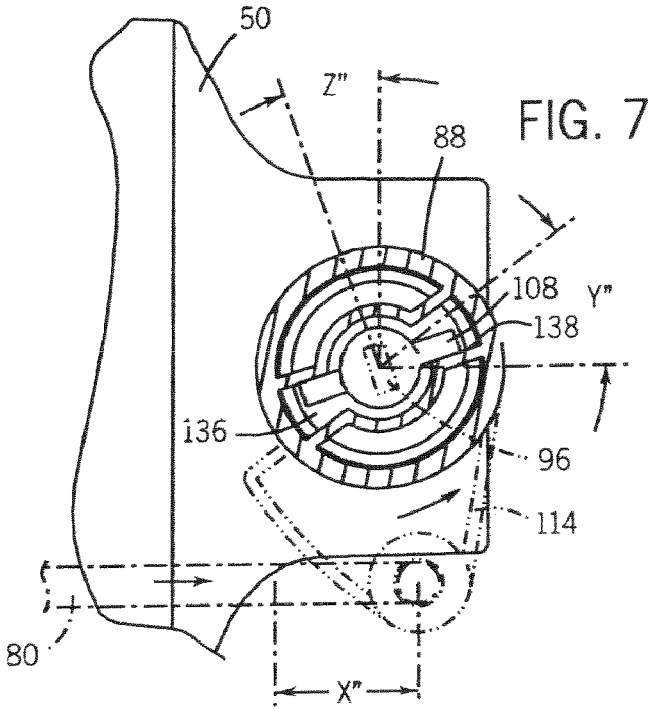
FIG. 7 is a view similar to FIGS. 4 and 5 and shows the throttle assembly rotated past the throttle assembly transition position.
Figure 8:
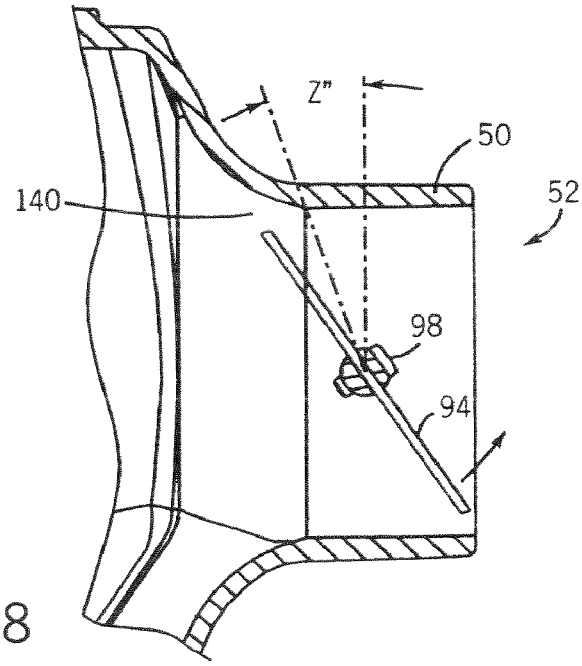
FIG. 8 is a view similar to FIG. 5 and shows the throttle assembly with the throttle plate rotated beyond the closed throttle plate position.

Comparing FIGS. 6 and 7, as an operator advances the throttle actuator beyond a distance X', shown in FIG. 6, any further increase in the position of the throttle actuator provides a corresponding rotation of throttle shaft 96 and opens throttle plate 94. As shown in FIG. 7, as third throttle link 80 is advanced a distance X", actuator 88 is rotated an angle of Y" while throttle shaft 96 rotates an angle of Z". The difference between Y" and Z" is equal to the amount of deadband engagement—distance Y', as shown in FIG. 6, between actuator 88 and throttle plate 94. Once third throttle link 80 is displaced a distance greater than X', as shown in FIG. 6, any further displacement of third throttle link 80 results in rotation of throttle shaft 96, as shown in FIG. 7. A leading edge 138 of recess 136 engages pin 108 and rotates throttle shaft 96. As leading edge 138 comes into contact with pin 108, as shown in FIGS. 7 and 8, throttle plate 94 rotates relative to opening 52 of throttle body 50. As shown in FIG. 8, when the throttle actuator is advanced beyond the transition throttle position, throttle plate 94 rotates to an open position, indicated by a gap 140 formed between throttle plate 94 and throttle body 50, allowing combustion gas to pass through opening 52.

Figure 9:
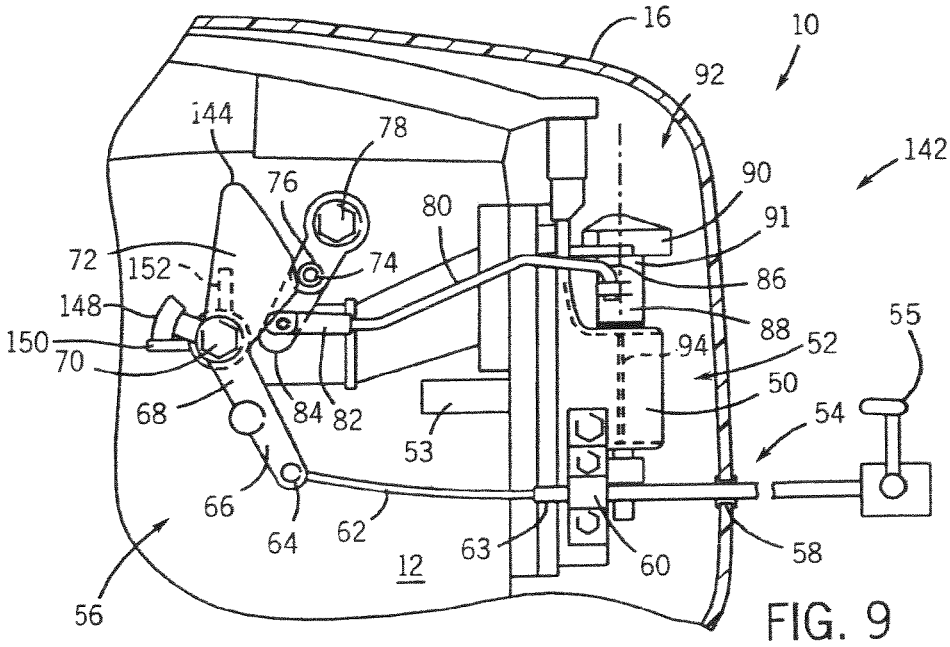
FIG. 9 is a detail of the throttle assembly of FIG. 2 with the throttle actuator, throttle linkage assembly, and throttle assembly in an idle throttle position.

During idle operation of outboard motor 10, as shown in FIG. 9, when throttle actuator 55 is in an idle throttle position 142, throttle plate 94 is disposed generally across opening 52 thereby preventing the passage of combustion gas therethrough. Opening 53 provides combustion gas to pass through throttle body 50 thereby providing idle operation combustion gas to engine 12. Second arm 72 of first throttle link 66 includes a cam, or cam face 144 constructed to engage pin 74 of second throttle link 76.

Figure 10:
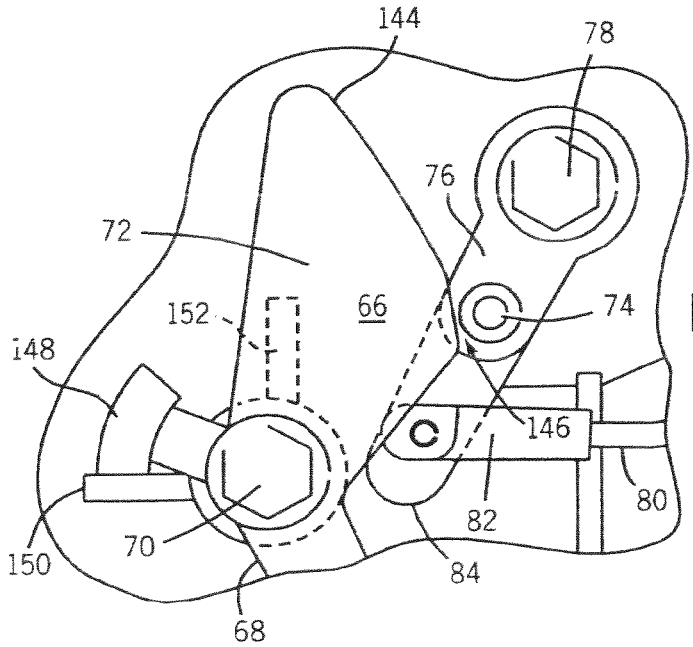
FIG. 10 is a detail of the throttle linkage assembly in the idle throttle position as shown in FIG. 9.
Figure 12:
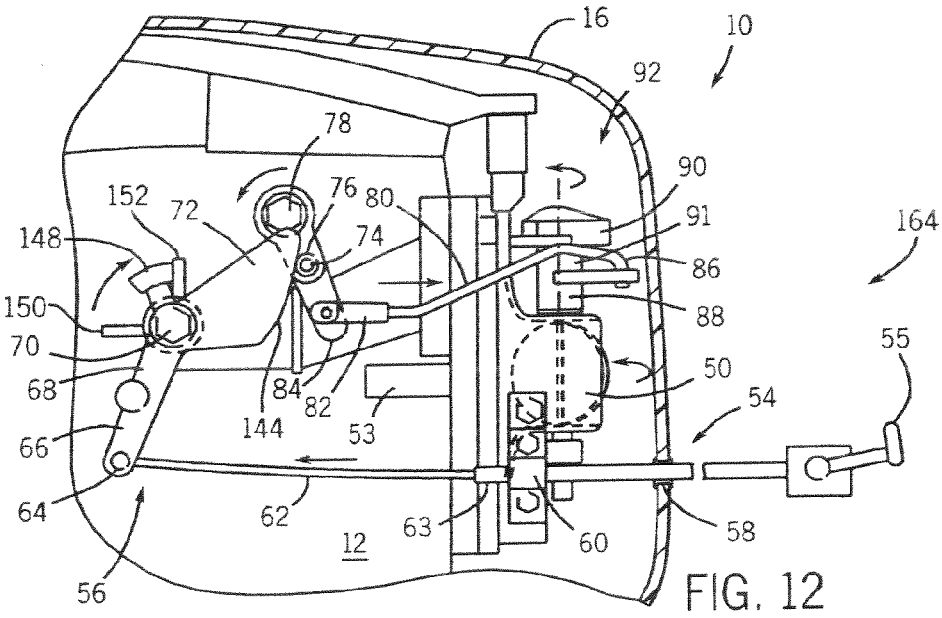
FIG. 12 is the throttle actuator, throttle linkage assembly, and throttle assembly of FIG. 9 advanced to a wide open throttle position.

As shown in FIG. 10, at idle operation of engine 12, a small gap 146 is formed between cam face 144 of first throttle link 66 and pin 78 of second throttle link 76. First throttle link 66 includes a tab, or third arm 148 integrally formed therewith. Third arm 148 is constructed to engage a first throttle stop 150 and a second throttle stop 152. Throttle stops 150, 152 are integrally formed with engine 12 and restrict the movement of throttle linkage 56 and define an idle throttle linkage position, as shown in FIGS. 9 and 10, and a wide open throttle linkage position, as shown in FIG. 12. Such a construction forms a throttle linkage assembly having no means of adjustment and wherein the range of rotation of each of the links of the throttle linkage assembly is permanently fixed.

Referring back to FIG. 9, with throttle actuator 55 in idle throttle position 142, third arm 148 of first throttle link 66 abuts first throttle stop 150 thereby permanently fixing the engine idle throttle linkage positions. Cam face 144 of second arm 72 of first throttle link 66 disengages from pin 74 with gap 146 therebetween. During idle throttle position 142, second throttle link 76, third throttle link 80, and actuator 88 are maintained in an idle position and mechanically separated from throttle actuator 55 by gap 146 between first and second throttle links 66, 76.

Figure 11:
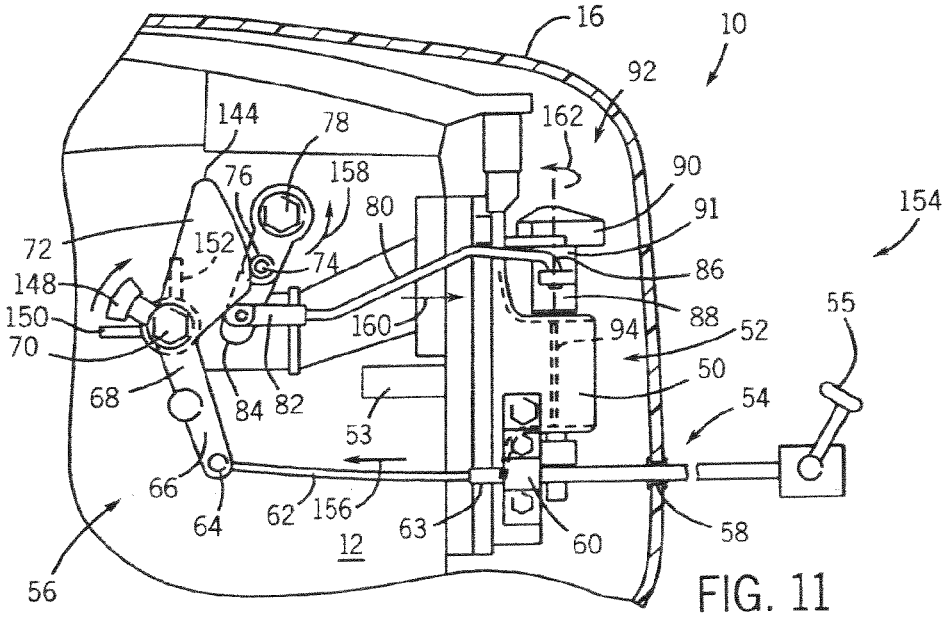
FIG. 11 is the throttle actuator, throttle linkage assembly, and throttle assembly of FIG. 9 advanced to an engine transition position.

As shown in FIG. 11, throttle actuator 55, throttle linkage assembly 56, throttle assembly 92 have been advanced to their respective engine transition positions 154. Throttle actuator 55 is shown advanced to a transition displacement, indicated by arrow 156, of throttle cable 62. Displacement 156 rotates first throttle link 66 such that third arm 148 disengages from first throttle stop 150 and rotates toward second throttle stop 152. Cam face 144 engages pin 74 of second throttle link 76 and slides there along rotating second throttle link about pin 78. Second throttle link 76 rotates in the direction of arrow 158 and displaces third throttle link 80 in the direction of arrow 160. Displacement 160 of third throttle link 80 rotates actuator 88 indicated generally by arrow 162.

Throttle position sensor 90 signals to the ECU the movement 162 of actuator 88. The ECU, in response to the signal from throttle position sensor 90, adjusts predetermined engine operating parameters. One of the engine parameters that is adjusted is the amount of fuel provided to the engine. The amount of fuel provided to the engine is increased in response to the throttle actuator adjustment. By adjust the amount of fuel provided to the engine at transition throttle position 154, the operating speed of the engine is increased. Even though the operating speed and the amount of fuel provided to the engine is increased, from idle throttle position 142, shown in FIG. 9, to transition throttle position 154 shown in FIG. 11, throttle plate 94 remains closed. This is accomplished because the air bypass 53 allows sufficient air induction into the engine via a second opening.

FIG. 12 shows a wide open throttle position 164. Throttle actuator 55 is fully advanced. Third arm 148 of first throttle link 66 is rotated into contact with second throttle stop 152. Second throttle stop 152 permanently fixes the position of throttle linkage assembly 56 and throttle assembly 92 during wide open throttle operation. Third throttle link 80 rotates actuator 88 beyond transition throttle position 154, as shown in FIG. 11, so that actuator 88 engages throttle plate 94. As shown in FIGS. 11 and 12, when the throttle actuator is advanced beyond transition throttle position 154 to wide open throttle position 164, throttle plate 94 rotates approximately 90 degrees relative to opening 52 thereby allowing combustion gas to pass therethrough. As engine 12 needs more combustion gas to mix with the fuel in order to transition from the stratified combustion stage to a homogeneous combustion stage, throttle plate 94 rotates in opening 52 to allow more combustion gas to pass therethrough. By maintaining the throttle plate closed across opening 52 during relatively low speed operation of engine 12, throttle assembly 92 reduces the amount of engine noise emitted toward an operator.

Therefore, in accordance with one embodiment of the present invention, a throttle assembly of an internal combustion includes a throttle body. A throttle plate is positioned in an opening of the throttle body and is constructed to control passage of combustion gas thereabout when opened. A mechanical actuator engages the throttle plate and has a deadband engagement therebetween whereby a portion of input motion to the mechanical actuator is not translated to the throttle plate.

According to another embodiment of a present invention, an outboard motor includes an engine mounted on a mid-section attachable to a transom of a boat. A throttle body is attached to the engine and has a passage therethrough with a throttle plate rotatably positioned therein. A throttle linkage is in operable association with the throttle plate to rotate the throttle plate in the passage of the throttle body. An actuator is positioned between the throttle linkage and the throttle plate such that the throttle plate is disengaged from operable association with the throttle linkage during a range of engine operation.

In accordance with a further embodiment of the present invention, an engine control system has a mechanical actuator connected to a throttle linkage. A throttle plate is positioned in a first opening of a throttle body and is rotatable between a closed position and an open position. The throttle plate is rotatably connected to the mechanical actuator such that the mechanical actuator is allowed to partially rotate relative to the throttle plate in response to an input from the throttle linkage. The engine control system includes an air intake bypass constructed to maintain flow of combustion air when the throttle plate is closed.

According to yet another embodiment of the present invention, a throttle assembly includes a throttle linkage connected to a user input, a throttle body having a first air intake opening, and a throttle plate rotatably positioned in the first air intake opening of the throttle body. A throttle translation assembly operably connects the throttle linkage to the throttle plate to provide translation of the throttle plate within one range of operation of the throttle linkage and prevent translation of the throttle plate in another range of operation of the throttle linkage.

According to a further embodiment of the present invention, a method of minimizing noise emitted from an intake of an internal combustion engine is disclosed. The method includes providing an air bypass in a location to minimize noise travel toward a user while providing sufficient air for a given range of engine operation, the air bypass having an opening open to atmosphere and directed in a direction different than that of a throttle plate, and allowing acceleration within the given range of operation without a corresponding change in throttle plate position.

In accordance with an even further embodiment of the present invention, a method of operating an internal combustion engine is disclosed which includes the step of increasing an amount of fuel provided to a combustion chamber while maintaining a closed throttle plate position.

While the present invention is shown as being incorporated into an outboard motor, the present invention is equally applicable with many other applications, some of which include inboard motors, snowmobiles, personal watercrafts, all-terrain vehicles (ATVs), motorcycles, mopeds, lawn and garden equipment, generators, etc.

The present invention has been described in terms of the preferred embodiment, and it is recognized that equivalents, alternatives, and modifications, aside from those expressly stated, are possible and within the scope of the appending claims.

What is claimed is:

1. A throttle assembly of an internal combustion engine comprising:

a throttle body having an opening therethrough;

a throttle plate positioned in the opening and constructed to control passage of combustion gas through the throttle body;

a mechanical actuator engaged with the throttle plate and having a deadband engagement therebetween whereby a portion of input motion to the mechanical actuator is not transmitted to the throttle plate; and an alternate air flow path in the throttle body to allow air into the internal combustion engine when the throttle plate is in a closed position, the alternate air flow path including a nozzle positioned in the throttle body on a side opposite the opening having the throttle plate therein.

2. The throttle assembly of claim 1 further comprising a throttle linkage attached to the mechanical actuator and wherein the mechanical actuator is arranged to allow movement of the throttle linkage to accelerate the internal combustion engine while maintaining the throttle plate in a position for at least a portion of the throttle linkage movement.

3. The throttle assembly of claim 1 wherein the alternate air flow path is on a side of the throttle body generally opposite a user.

4. The throttle assembly of claim 1 wherein the alternate air flow path includes a second opening in the throttle body in communication with the opening having the throttle plate therein.

5. The throttle assembly of claim 1 further comprising a recess in the mechanical actuator that is engagable with a throttle shaft supporting the throttle plate in the opening of the throttle body such that a position of the throttle shaft is independent of an input to the mechanical actuator in the deadband.

6. The throttle assembly of claim 5 wherein the recess has a bowtie shaped cross-section.

7. The throttle assembly of claim 1 wherein the mechanical actuator has an input and an output, and wherein the throttle assembly further includes a throttle linkage attached to the input of the mechanical actuator and wherein the mechanical actuator is constructed to allow rotation of the input that exceeds rotation of the output.

8. The throttle assembly of claim 7 wherein the rotation of the input exceeds rotation of the output by approximately 17 degrees.

9. The throttle assembly of claim 1 wherein the deadband engagement allows an input to the mechanical actuator to move up to approximately 20 degrees without affecting a position of the throttle plate.

10. The throttle assembly of claim 1 wherein the mechanical actuator further comprises a first end engagable with the throttle plate and a second end engagable with a mount attached to the throttle body.

11. The throttle assembly of claim 10 wherein the mount is a throttle position sensor and the mechanical actuator is rotatable relative thereto.

12. The throttle assembly of claim 11 wherein the throttle plate, the mechanical actuator, and the throttle position sensor share a common axis of rotation wherein rotation of the mechanical actuator is sensed by the throttle position sensor while the throttle plate remains stationary for a portion of a total rotation range of the mechanical actuator.

13. The throttle assembly of claim 1 wherein the mechanical actuator has a body and an arm extending therefrom wherein the arm is pivotally connected to a throttle linkage.

14. The throttle assembly of claim 1 incorporated into at least one of an outboard motor, an ATV, a snowmobile, and a motorcycle.

15. An outboard motor comprising:

an engine mounted on a midsection attachable to a transom of a boat;

a throttle body attached to the engine and having a passage therethrough:

a throttle plate rotatably positioned in the passage;

a throttle linkage in operable association with the throttle plate to rotate the throttle plate in the passage of the throttle body;

an actuator positioned between the throttle linkage and the throttle plate such that the throttle plate is disengaged from operable association with the throttle linkage during a range of engine operation;

a throttle plate shaft extending through the throttle body and having the throttle plate attached thereto;

an input shaft extending from the actuator; and a throttle position sensor positioned to directly sense position of the actuator input shaft, the actuator having a cylindrical body having the input shaft extending from one end and a recess constructed in an opposite end to receive a portion of the throttle plate shaft therein, the input shaft of the actuator being directly coupled to the throttle position sensor such that rotation of the actuator results in a change to a throttle position sensor signal.

16. The outboard motor of claim 15 wherein the range of engine operation is defined as an idle operation to a low speed operation.

17. The outboard motor of claim 15 further comprising a bushing having a bearing surface and positioned about an end of the throttle plate shaft and constructed to support the actuator about the bearing surface.

18. The outboard motor of claim 15 wherein the throttle plate shaft has a roll pin passing therethrough that loosely engages the recess in the cylindrical body such that the actuator is free to partially rotate relative to the throttle shaft.

19. The outboard motor of claim 15 wherein the engine is operable in a stratified combustion operation and a homogeneous combustion operation and the throttle plate is mechanically disassociated with the throttle linkage when in stratified combustion operation until the engine transitions to the homogeneous combustion operation.

20. An engine control system comprising:

a throttle linkage;

a mechanical actuator connected to the throttle linkage;

a throttle body having a first opening therein;

a throttle plate positioned in the first opening of the throttle body and rotatable between a closed position and an open position, the throttle plate rotatably connected to the mechanical actuator such that the mechanical actuator is allowed to partially rotate relative to the throttle plate in response to an input from the throttle linkage; and an air intake bypass constructed to maintain flow of combustion air when the throttle plate is in the closed position, the air intake bypass being in a side of the throttle body opposite the one having the throttle plate therein.

21. The engine control system of claim 20 further comprising a throttle plate position sensor positioned about an end of the mechanical actuator and directly coupled thereto, the throttle position sensor configured to sense rotation of the mechanical actuator.

22. The engine control system of claim 20 wherein the air intake bypass is in the throttle body.

23. The engine control system of claim 20 further comprising a spacer disposed between the mechanical actuator and the throttle body and constructed to prevent wear therebetween.

24. The engine control system of claim 20 wherein the mechanical actuator is allowed to rotate at least ten percent of a total range of rotation of the throttle plate without affecting the position of the throttle plate.

25. A method of minimizing noise emitted from an intake of an internal combustion engine comprising:

providing an air bypass in a location to minimize noise travel toward a user while providing sufficient air for a given range of engine operation, the air bypass having an opening open to atmosphere and directed in a direction different than that of a throttle plate; and allowing acceleration between an idle operation and a low speed operation without a corresponding change in throttle plate position, the low speed operation being determined when the engine transitions from a stratified combustion charge to a homogeneous combustion charge.

26. The method of claim 25 further comprising at least partially opening the throttle plate when the engine requires a generally homogeneous combustion charge.

27. The method of claim 25 further comprising completely closing the throttle plate during deceleration of the engine prior to desiring an idle engine speed.

28. A throttle assembly of an internal combustion engine comprising:

a throttle body having an opening therethrough;

a throttle plate positioned in the opening and constructed to control passage of combustion gas through the throttle body; and a mechanical actuator engaged with the throttle plate and having a deadband engagement therebetween whereby a portion of input motion to the mechanical actuator is not transmitted to the throttle plate; and a throttle position sensor associated with the mechanical actuator and capable of sensing movement of the mechanical actuator during the portion of input motion to the mechanical actuator which is not transmitted to the throttle plate.

29. The throttle assembly of claim 28 wherein predetermined engine operating parameters are adjusted during the portion of a total rotation range of the mechanical actuator in response to a signal from the throttle position sensor.

30. The throttle assembly of claim 28 wherein the throttle plate, the mechanical actuator, and the throttle position sensor have a common axis of rotation.

* * * * *